US005333040A

United States Patent [19]

Imamiya

[11] Patent Number: 5,333,040

[45] Date of Patent: Jul. 26, 1994

[54] DEVELOPING DEVICE HAVING IMPROVED TONER TRANSPORT CAPACITY FOR USE IN AN IMAGE FORMING APPARATUS

[75] Inventor: Koji Imamiya, Kanagawa, Japan

[73] Assignee: Kabushiki Kaisha Toshiba, Kawasaki, Japan

[21] Appl. No.: 950,206

[22] Filed: Sep. 24, 1992

[30] Foreign Application Priority Data

Sep. 27, 1991 [JP] Japan ..... 3-248991

[51] Int. Cl.[5] ..... G03G 15/00

[52] U.S. Cl. ..... 355/246; 118/661; 355/245

[58] Field of Search ..... 355/245, 246, 251, 253, 355/259; 118/653, 656, 11, 651, 661

[56] References Cited

U.S. PATENT DOCUMENTS

| | | | |
|---|---|---|---|
| 4,408,862 | 10/1983 | Talcano et al. | 355/250 |
| 4,930,438 | 6/1990 | Demizu et al. | 118/651 |
| 4,947,211 | 8/1990 | Ono et al. | 355/265 |
| 4,990,858 | 2/1991 | Brewington et al. | 355/245 |
| 5,062,385 | 11/1991 | Nishio et al. | 118/653 |
| 5,170,213 | 12/1992 | Yamaguchi et al. | 355/246 |
| 5,179,414 | 1/1993 | Bhagat | 355/259 |
| 5,182,601 | 1/1993 | Hodoshima et al. | 355/270 |

FOREIGN PATENT DOCUMENTS 62-211674 9/1987 Japan .

*Primary Examiner*—A. T. Grimley
*Assistant Examiner*—T. A. Dang
*Attorney, Agent, or Firm*—Limbach & Limbach

[57] ABSTRACT

A device for developing a latent image on an image carrier in an image forming apparatus is disclosed which includes a developing roller adjacent to the image carrier for transferring a developing agent to the image carrier, a supply roller adjacent to the developing roller for supplying the developing agent to the developing roller and a conductive member contacted with the developing roller. A voltage is applied to the conductive member for generating an electric field on the supply roller to adhere the developing agent onto the surface of the supply roller.

8 Claims, 4 Drawing Sheets

DEVELOPING DEVICE HAVING IMPROVED TONER TRANSPORT CAPACITY FOR USE IN AN IMAGE FORMING APPARATUS

BACKGROUND OF THE INVENTION

1. Field of the Invention

The present invention relates to a developing device in which an electrostatic latent images formed on an image carrier is converted into a visible image in an image forming apparatus such as electrophotographic apparatus or electrostatic recording apparatus.

2. Description of the Related Art

A developing device in which a non-magnetic toner is used is known. This type of developing device includes a rotatable developing roller for supplying the non-magnetic toner to an image carrier such as a photosensitive drum. The developing roller receives the non-magnetic toner from a toner hopper in which the non-magnetic toner is contained. A toner supply roller, which is located in the toner hopper, rotates in the same direction as the developing roller to transport the non-magnetic toner to the developing roller. Then a toner thin layer is formed on the surface of the developing roller by a thin layer forming member which is in linear contact with the developing roller at a uniform pressure. The thin toner layer passes close to, or into contact with, the image carrier holding an electrostatic latent image to form a toner image on the image carrier.

However, there was a problem in the above-mentioned conventional developing device in that the capacity for transporting toner to the developing roller was insufficient. For instance, when printing a whole-surface solid image on paper, the image density at the trailing edge of the paper was less than that of the image density at the leading edge.

Also, poor toner layer formation occurred when executing continuous printing operations using the above conventional developing device. This resulted in reduction of image density.

Japanese Laid Open Patent No. 62-211674 discloses a developing device including a corona charger so called a corotron is located in the toner hopper for electrofying a non-magnetic one-component toner. The corotron comprises a conductive case and a corona wire. Since the case has an opening portion, the toner will intrude into the case. As a result, the case is filled by the toner. Therefore, corona charging operation will not perform sufficiently.

SUMMARY OF THE INVENTION

It is an object of the present invention to provide a developing device which has sufficient transport capacity for the developing agent and does not lead to differences in, or reduction of, image density.

According to the present invention there is provided a device for developing a latent image on an image carrier in an image forming apparatus, comprising first roller means adjacent to the image carrier for transferring a developing agent to the image carrier, second roller means adjacent to the first roller means for supplying the developing agent to the first roller means, a conductive member in contact with the second roller means, and means for applying a voltage to the conductive member to generate an electric field on the second roller means to adhere the developing agent onto the surface of the second roller means.

Further, according to the present invention there is provided a device for developing a latent image on an image carrier in an image forming apparatus, comprising first roller means adjacent to the image carrier for transferring a developing agent to the image carrier, second roller means adjacent to the first roller means for supplying the developing agent to the first roller means, and a friction charging member in contact with the second roller means to generate a friction charge on the second roller means to adhere the developing agent on the surface of the second roller means.

DETAILED DESCRIPTION OF THE PREFERRED EMBODIMENTS

Referring to the accompanying drawings, a detailed description will subsequently be given of the preferred embodiment of the present invention.

Figure 1:
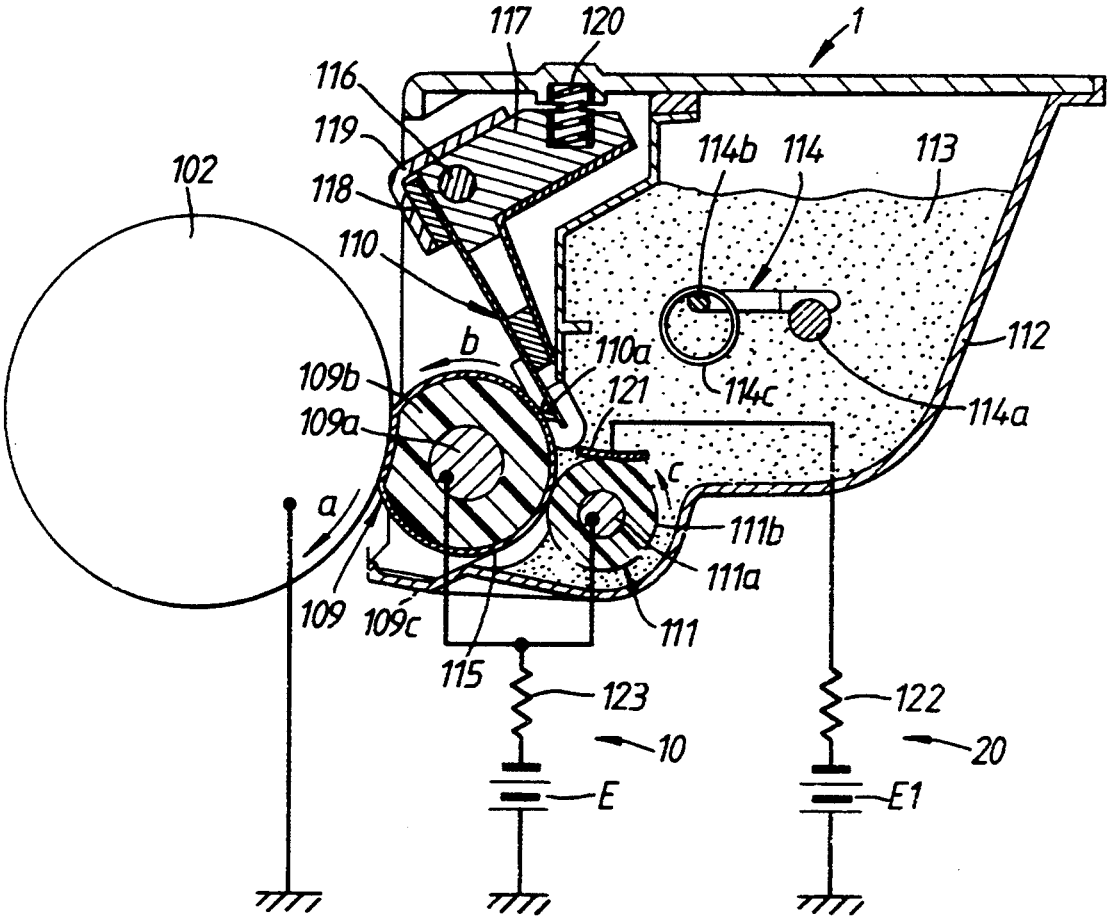
FIG. 1 is a cross-sectional view showing the overall composition of a developing device of an embodiment of the present invention.

FIG. 1 is a cross-sectional view showing the overall composition of a one-component non-magnetic developing device 1 (hereafter, simply "developing device") which is an embodiment of the present invention.

Developing device 1 is positioned adjacent to photosensitive drum 102, which is rotated in the direction of arrow a.

Developing device 1 comprises toner container 112, developing roller 109, supply roller 111, mixer 114 and blade 110. Toner container 112 contains non-magnetic toner 113 (hereafter, simply "toner") as a developing agent therein. Developing roller 109 is located in one end of toner container 112 in a contact state with photosensitive drum 102 and is rotated in the direction of arrow b. Developing roller 109 has conductivity and elasticity. Supply roller 111 is located in a contact state with developing roller 109 and so that supply roller 111 may be rotated in the direction of arrow c. Mixer 114 is arranged in toner container 112 to agitate toner 113 for supplying toner 113 toward supply roller 111 and preventing the coagulation of toner 113. Mixer 114 comprises rotational axis **114*a*, mounting bar 114*b* fixed to rotational axis 114*a* and coil spring 114*c* mounted to mounting bar 114b. Blade 110 is located in a contact state with the outer surface of developing roller 109. Blade 110 provides a thin layer forming means to form a thin layer of toner 113 which is transported to developing roller 109 from supply roller 111**.

Moreover, developing device 1 includes bias power source applying unit 10, conductive member 121 and voltage applying unit 20. Bias power source applying unit 10, composed of resistor 123 and direct current power source E, is connected to developing roller 109 and supply roller 111 to apply specified bias voltage to developing roller 109 and supply roller 111. Conductive member 121, which may be formed of metal, is positioned in contact with supply roller 111. Voltage applying unit 20, composed of resistor 122 and direct current power source E1, is connected to conductive member 121 to apply specified voltage to conductive member 121. Depending on the polarity of toner 113, the specified voltage from voltage applying unit 20 to conductive member 121 is set to be the same voltage as the bias voltage from bias power source applying unit 10, or a voltage with a high absolute value greater than that of the bias power source applying unit 10. This specified voltage applied to conductive member 121 generates an electric field on supply roller 111 to adhere toner 113 electrostatically onto supply roller 111.

A trailing edge portion of blade 110 is supported on the device main body by first blade holder 117, spacer 118 and second blade holder 119. In order to press with suitable force the surface of developing roller 109 with its curved portion 110a formed on the leading edge portion, blade 110 is always energized by a spring 120, using rotating shaft 116 as a fulcrum. The spring constant of spring 120 is set to be less than the spring constant of blade 110. For this reason, even if the contact portion of blade 110 wears, there is hardly any change in its pressure. Thus, a stable thin toner layer formation capacity on developing roller 109 can be maintained over a long period. A recovery blade 115 made of a polyethylene terephthalate film such as the film sold by Dupont Corp. under the trademark "Mylar" is arranged below developing roller 109 in contact with the surface of developing roller 109.

Supply roller 111 has the function of scraping off that part of toner 113 which has not been transferred onto photosensitive drum 102 and remains on developing roller 109 besides transporting toner 113 from toner container 112 to developing roller 109.

The peripheral speed of photosensitive drum 102 is set at, for instance, 70 mm/sec and the peripheral speed of developing roller 109 is set at, for instance, 180 mm/sec.

Figure 2:
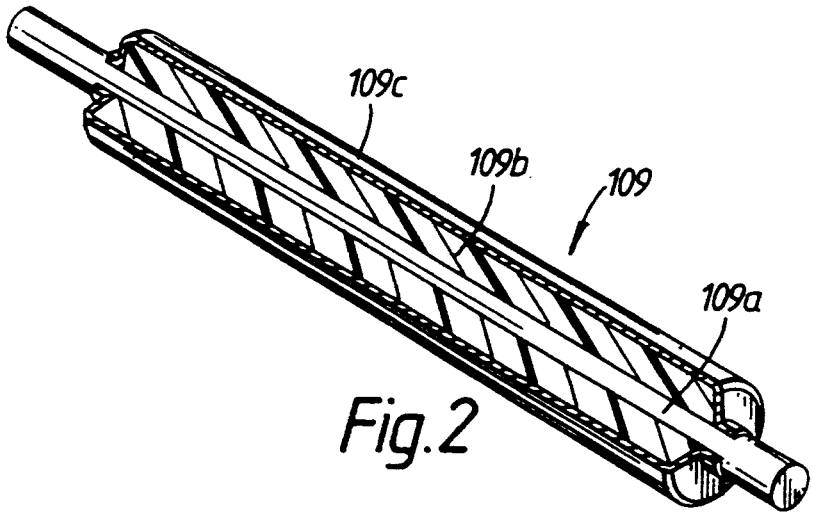
FIG. 2 is a perspective cross-sectional view showing the structure of the developing roller in the developing device shown in FIG. 1.

Developing roller 109 will now be described in more detail with reference to FIG. 2.

Developing roller 109 has a two-layer construction, including elastic layer 109b around the periphery of metallic shaft 109a and conductive layer 109c on the surface of this elastic layer 109b.

Silicon rubber of rubber hardness 25 degrees, extension about 425% and resistance value about $5\times10^3$ Ω·cm is used for elastic layer 109b. Conductive polyurethane coating material, for example, "Sparex" (trade name) (manufactured by Nippon Miractran Co., Ltd.) having a resistance value about $5\times10^3$ Ω·cm and an extension about 353% is used for conductive layer 109c, and the layer thickness is about 70 μm. As a result, the rubber hardness of developing roller 109 which is formed was about 30 degrees, the resistance of shaft 109a and conductive layer 109c is 100 kΩ, and the surface roughness is about 3 μm.

Supply roller 111 is a roller which has soft polyurethane foam layer 111b with a conductivity of less than $10^6$ Ω·cm around the periphery of metal shaft 111a. Supply roller 111 is rotated in the direction of the arrow c in FIG. 1 at a peripheral speed of 90 mm/sec.

The following is a description of the voltage and polarity of bias power source applying unit 10 and voltage applying unit 20.

Since a reversal development technique using negatively chargeable photosensitive drum 102 is applied in this embodiment, the charge of toner 113 is a negative charge. For this reason, the surface potential of photosensitive drum 102 is −550 V and a developing bias voltage of −220 V is applied to metal shaft 109a of developing roller 109 via resistor 123 of 100 kΩ to 50 MΩ.

The operation of developing device 1 will now be described with reference to FIGS. 1 and 3.

Toner 113 in toner container 112 is transported to supply roller 111 while being agitated by mixer 114. After being rubbed between conductive member 121 and supply roller 111, the toner is supplied to the outer periphery of developing roller 109.

Toner 113, which has been supplied to developing roller 109, is negatively charged by friction with the surface of rotating developing roller 109 and is transported by being electrostatically adhered to the surface of developing roller 109. Then, the amount of toner 113, which is adhered to the surface of developing roller 109 and transported, is regulated by blade 110 and is formed into a uniform thin layer. At the same time, toner 113 is recharged by the friction between developing roller 109 and blade 110, and is transported as a fine toner layer. After this, toner 113 adhered to the surface of developing roller 109 is transferred to the electrosatic latent image on the surface of photosensitive drum 102 by close to or contact with photosensitive drum 102. By this means, the electrostatic latent image is converted into the visible image. Any toner 113 on the surface of developing roller 109 which has not been transferred passes through recovery blade 115 and returns to toner container 112.

In developing device 1 to which a non-magnetic one-component developing technique is applied, non-magnetic toner 113 cannot be transported using magnetic force. Therefore, when developing a solid image, the supply of toner 113 to developing roller 109 cannot be met. Consequently, the difference between the image density at the leading edge of the paper and the image density at the trailing edge of the paper increases.

Figure 3:
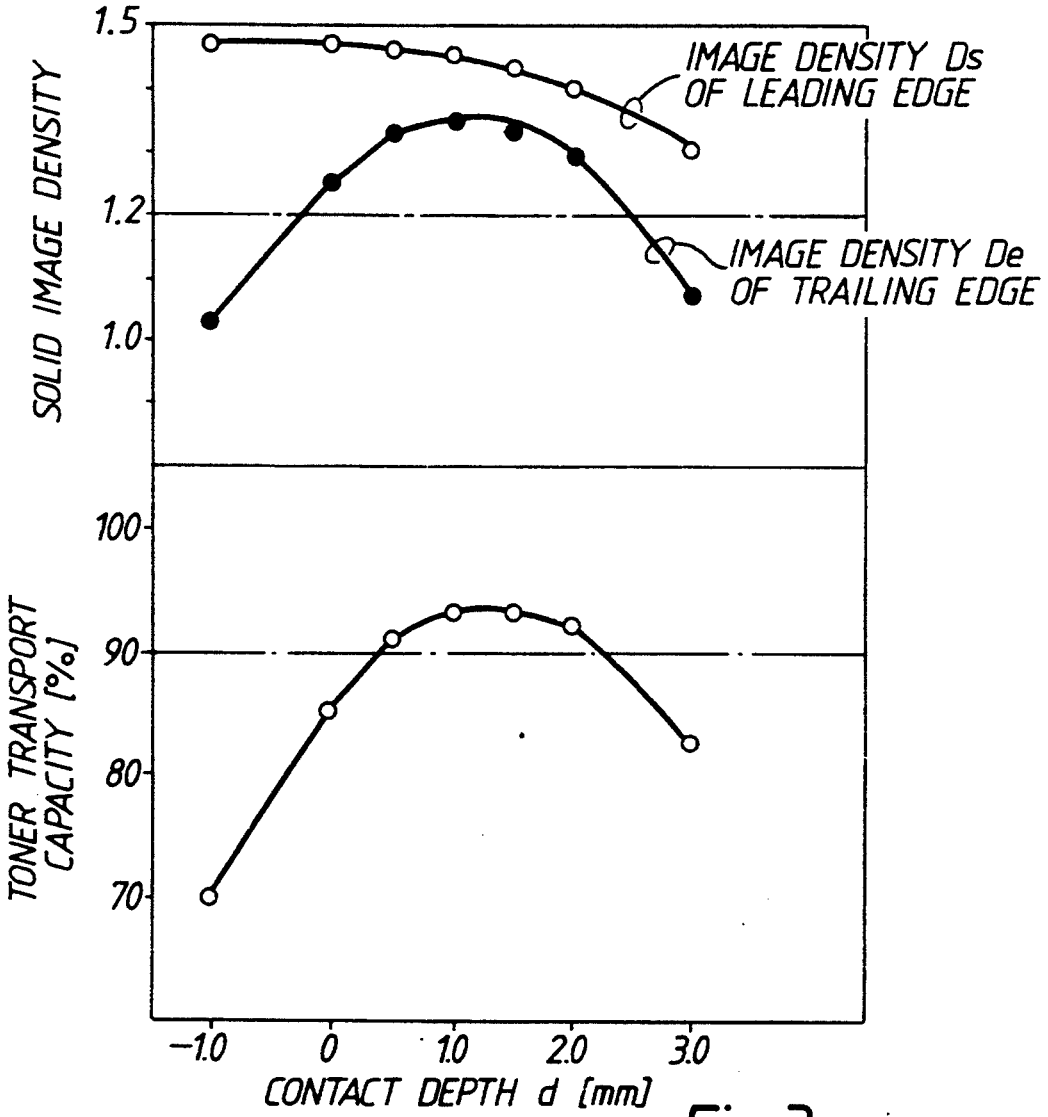
FIG. 3 is a graph showing the relationship between the contact depth of a conductive member against a supply roller and the leading edge density of a solid image, the trailing edge density of a solid image and the toner transport capacity in the developing device shown in FIG. 1.

FIG. 3 shows the results of defining the toner transport capacity Rb as Rb %=(De/Ds)×100% and evaluating the image densities of the leading edges and trailing edges of solid images on the paper. The toner transport capacity Rb represents the capacity of toner transportation from toner container 112 to developing roller 109. Here, Ds denotes solid image density at the leading edge of the paper, and De denotes solid image density at the trailing edge of the paper.

FIG. 3 shows the image density Ds at the leading edge of the paper, the image density De at the trailing edge of the paper and the toner transport capacity Rb for an A4 size solid image on the paper when a metal plate (SUS 304 (JIS)) of 1 mm thickness is used as conductive member 121 and the contact depth of conductive member 121 to supply roller 111 is taken as d mm.

Figure 4:
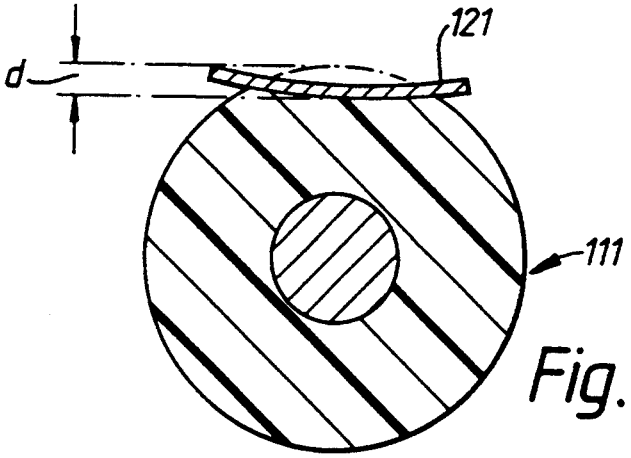
FIG. 4 is a cross-sectional view showing the contact condition of a conductive member to a supply roller.

As used in this application, the term "contact depth" refers to the distance d in the direction of the compression between the outer surface of supply roller 111 when soft layer 111*b* is uncompressed and the point of maximum compression of soft layer 111*b* when conductive member 121 is biased against supply roller 111, as shown in FIG. 4.

As shown in FIG. 3, when image density Ds at the leading edge of the paper and image density De at the trailing edge of the paper are each greater than 1.2 and toner transport capacity Rb is above 90%, it can be judged as a good solid image on the paper.

That is, when contact depth d is less than 0.5 mm, or when contact depth d is greater than 2.0 mm, toner transport capacity Rb becomes less than 90%, and the toner transport capacity becomes poor.

The graphs shown in FIG. 3 are for the case of the bias voltage applied to developing roller 109 being −220 V, the bias voltage applied to toner supply roller 111 being −300 V and the voltage applied to conductive member 121 being −300 V.

Also, when the voltage applied to conductive member 121 was made −200 V, the toner transport capacity did not become over 90% within the region in which contact depth d was 0.5 mm to 2.0 mm. When the voltage applied to conductive member 121 was made −400 V, the result was almost the same as that shown in FIG. 3, and the toner transport capacity became over 90% within the region in which d=0.5 mm to 2.0 mm.

When a conductive member was not used, the same result as the case of contact depth d=−1.0 mm shown in FIG. 3 was obtained.

In this embodiment, since the developing technique was reversal development which used a negatively chargeable photosensitive drum 102, the charge of toner 113 was a negative charge. For this reason, negative polarity bias voltages were applied to developing roller 109 and supply roller 111 from bias power source applying unit 10. Also, the design was to apply to conductive member 121 from voltage applying unit 20 a negative polarity voltage which was equal to, or more negative than, the above bias voltage. Conversely, in the case of a developing technique in which the charge of toner 113 is a positive charge, a voltage which is equal, or more negative than, the positive polarity bias voltage applied to supply roller 111 may be applied by changing the polarity of voltage applying unit 20.

Another embodiment of the present invention will now be described with reference to FIGS. 4 to 6.

Figure 5:
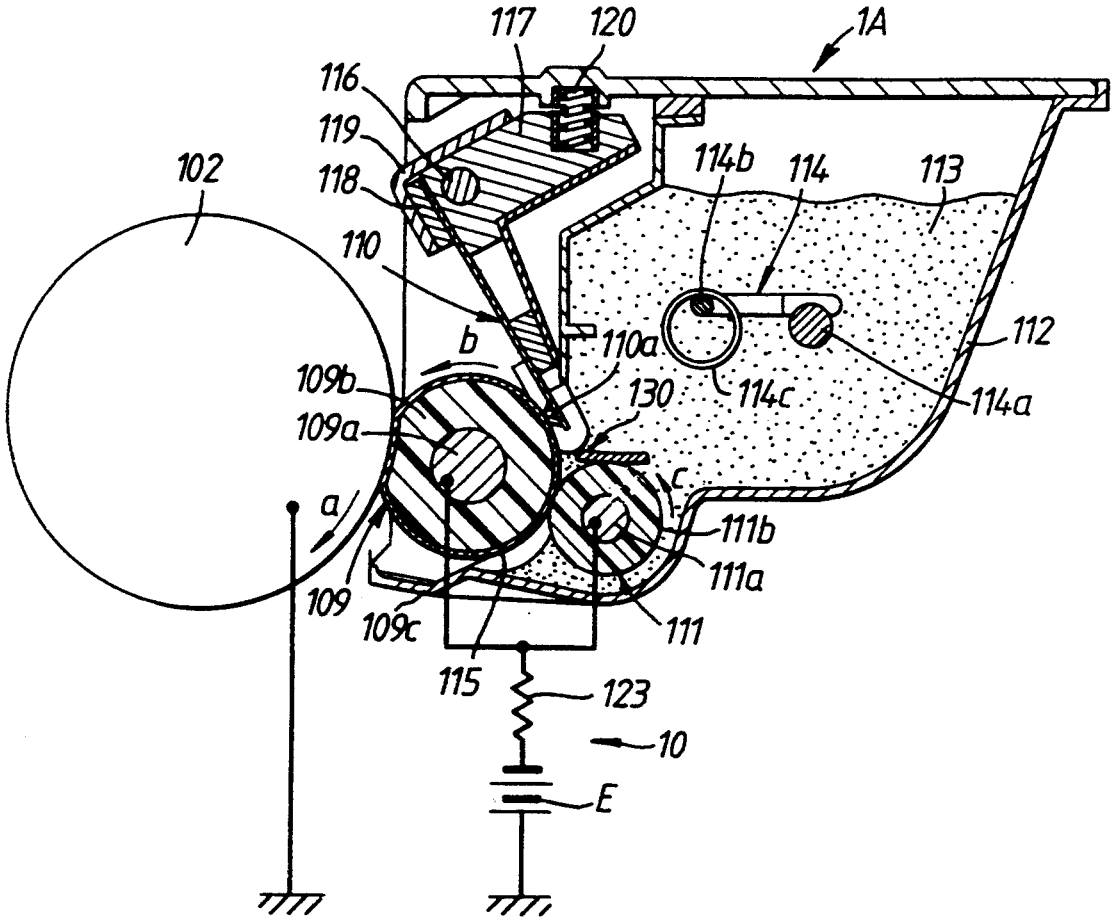
FIG. 5 is a cross-sectional view showing the overall composition of a developing device of another embodiment of the present invention.

In developing device 1A shown in FIG. 5, the same reference numerals are used for components having the same functions as in developing device 1.

Developing device 1A shown in FIG. 5 has the characteristic that friction charging member 130 is arranged in contact with the outer periphery of supply roller 111 in place of conductive member 121 and voltage applying unit 20.

Figure 6:
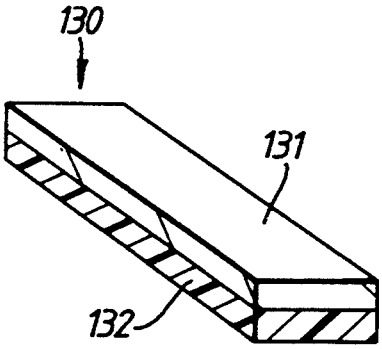
FIG. 6 is a perspective view showing a friction charging member used in the developing device shown in FIG. 5.

As shown in FIG. 6, friction charging member 130 is made by laminating friction charge supply plate 132 on the upper surface of support member 131, which is made of 1 mm thick metal plate (SUS 304 (JIS)). In the case of toner 113 being of negative polarity as in this embodiment, friction charge supply plate 132 is formed from a material which is more positive in the friction charge series than toner 113. In this case, silicon rubber, polyamide resin, melamine resin, polyurethane resin or acrylic resin is used as the material for friction charge supply plate 132.

Conversely, in the case of toner 113 being of positive polarity, friction charge supply plate 132 is formed from a material which is more negative in the friction charge series than toner 113. In this case, fluororesin, vinyl chloride resin, polyolefine resin or epoxy resin is used as the material for friction charge supply plate 132.

Figure 7:
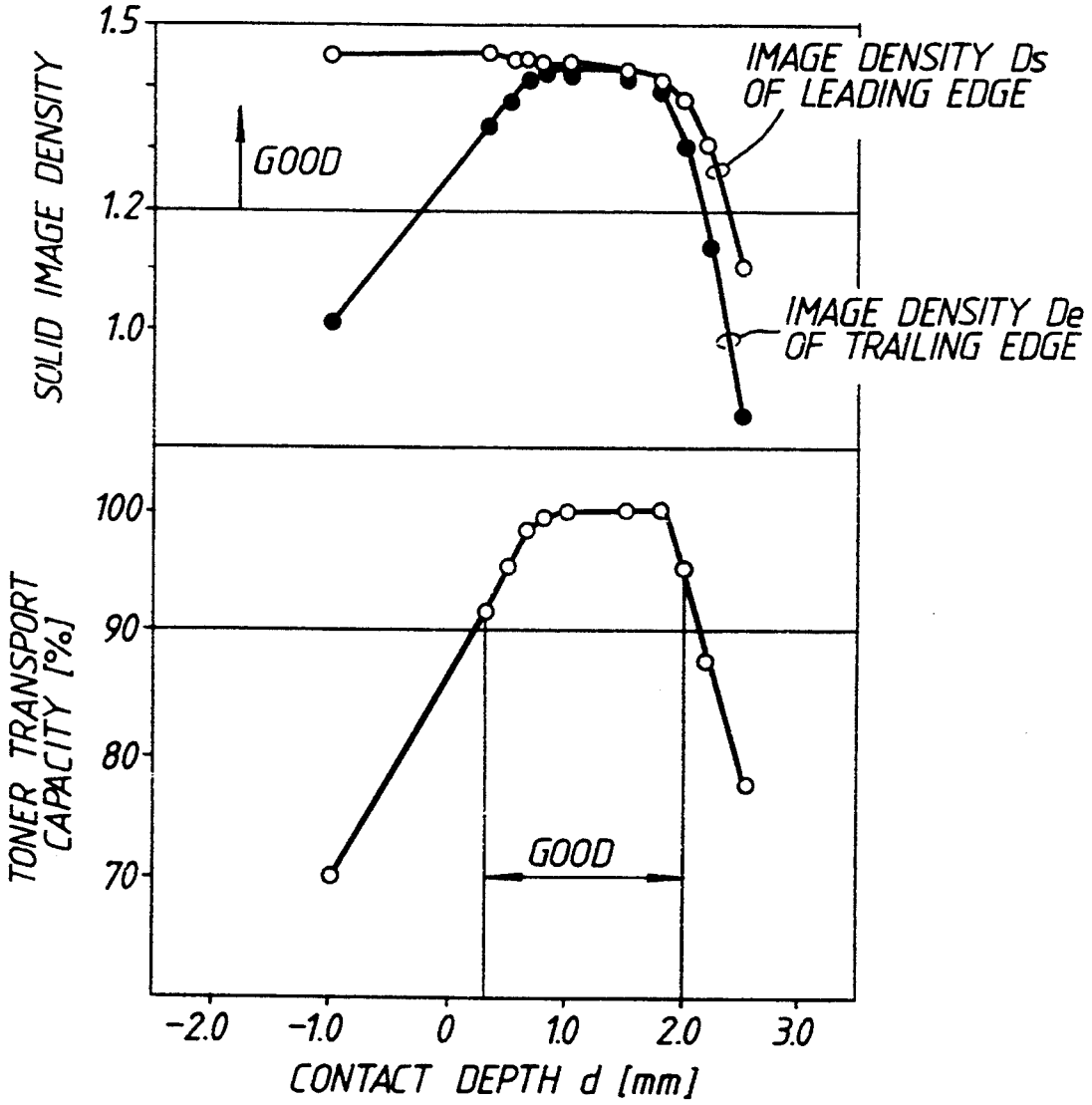
FIG. 7 is a graph showing the relationship between the contact depth of the friction charge member against the supply roller and the leading edge density of a solid image, the trailing edge density of a solid image and the toner transport capacity in the developing device shown in FIG. 5.

FIG. 7 shows the image density Ds at the leading edge of the paper, the image density De at the trailing edge of the paper and the toner transport capacity Rb for an A4 size solid image on the paper when friction charge supply plate 132 of friction charging member 130 is formed of silicon rubber and the contact depth of friction charging member 130 to supply roller 111 is taken as d mm.

As is evident from FIG. 7, when contact depth d is greater than 2.0 mm or when contact depth d is less than 0.3 mm toner transport capacity Rb becomes less than 90% and results in a poor state.

When a friction charging member is not used, the result was the same as the case of contact depth d=−1.0 mm shown in FIG. 7. Also, in the case of using fluororesin in friction charging member 130, toner transport capacity Rb did not exceed 90% in the region of contact depth d=−1.0 mm to 3.0 mm.

According to the present invention, the adhesion of the developing agent to the supply roller increases, and the transport capacity of developing agent to the developing roller improves. Thus, a developing device can be provided which can contribute to the formation of good quality images without resulting in deterioration of image density or reduction of image density during continuous printing.

The present invention may be embodied in other specific forms without departing from the spirit or essential characteristics thereof. The present embodiment is therefore to be considered in all respects as illustrative and not restrictive, the scope of the present invention being indicated by the appended claims rather than by the foregoing description and all changes which come within the meaning and range of equivalency of the claims are therefore intended to be embraced therein.

What is claimed is:

1. A device for developing a latent image on an image carrier in an image forming apparatus, comprising:

a developing roller positioned adjacent to the image carrier for transferring a developing agent to the image carrier;

a supply roller, positioned adjacent to the developing roller, for supplying the developing agent to the developing roller, the supply roller having a soft foam layer on the surface of the supply roller;

first applying means for applying a specified bias voltage to the supply roller so that the supply roller transfers the developing agent;

a conductive plate positioned in contact with the soft foam layer the supply roller, a contact depth between the soft foam layer of the supply roller, a contact depth between the soft foam layer and the conductive plate being more than 0.5 mm and less than 2.0 mm; and second applying means for applying a voltage to the conductive plate to generate an electric field on the supply roller to adhere the developing agent onto the surface of the soft foam layer, the voltage applied from the second applying means to the conductive plate being set to be the same voltage as or greater than the bias voltage applied from the first applying means to the supply roller.

2. The device of claim 1 further comprising means for forming a layer of the developing agent on the developing roller.

3. The device of claim 1 wherein the supply roller includes a rotatable shaft and the soft foam layer is a polyurethane foam layer formed on the periphery of the shaft.

4. A device for developing a latent image on an image carrier in an image forming apparatus, comprising:

a supply roller, positioned adjacent to the image carrier for transferring a developing agent to the image carrier;

a supply roller, positioned adjacent to the developing roller, for supplying the developing agent to the developing roller, the supply roller having a soft foam layer on the surface of the supply roller; and a friction charging supply plate, positioned in contact with the soft foam layer of the supply roller, for charging the developing agent, a contact depth between the soft foam layer and the friction charging supply plate being more than 0.3 mm and less than 2.0 mm, the friction charging supply plate having a material which is more positive in the friction charge series than the developing agent when the developing agent is of negative polarity and having a material which is more negative in the friction charge series than the developing agent when the developing agent is of positive polarity.

5. The device of claim 4 wherein the friction charging supply plate includes a material selected from the group consisting of silicon rubber, polyamide resin, melamine resin, polyurethane resin and acrylic resin when the developing agent has a negative polarity.

6. The device of claim 4 wherein the friction charging supply plate includes a material selected from the group consisting of fluororesin, vinyl chloride resin, polyolefine resin and epoxy resin when the developing agent has a positive polarity.

7. The device of claim 4 further comprising means for forming a layer of the developing agent on the developing roller.

8. The device of claim 4 wherein the supply roller includes a shaft and wherein the soft porous layer comprises a polyurethane foam layer formed on the periphery of the shaft.

* * * * *